US005318351A

United States Patent [19]

Walker

[11] Patent Number: 5,318,351

[45] Date of Patent: Jun. 7, 1994

[54] CUTTING TOOL BIT ASSEMBLY

[76] Inventor: Ralph L. Walker, P.O. Box 771, Springfield, Oreg. 97477

[21] Appl. No.: 983,900

[22] Filed: Dec. 1, 1992

[51] Int. Cl.[5] ..... F21C 25/10; F21C 35/18

[52] U.S. Cl. ..... 299/86; 299/91

[58] Field of Search ..... 299/79, 86, 91, 92, 299/93; 175/427

[56] References Cited

U.S. PATENT DOCUMENTS

| | | | |
|---|---|---|---|
| 4,006,936 | 2/1977 | Crabiel | 299/92 X |
| 4,299,424 | 11/1981 | LeBegue et al. | 299/93 |
| 4,337,980 | 7/1982 | Krekeler | 299/91 |
| 4,763,956 | 8/1988 | Emmerich | 299/86 |
| 4,944,560 | 7/1990 | Osterwise | 299/91 |

FOREIGN PATENT DOCUMENTS

| | | | |
|---|---|---|---|
| 1160288 | 8/1969 | United Kingdom | 299/91 |
| 9008246 | 7/1990 | World Int. Prop. O. | 299/91 |

*Primary Examiner*—David J. Bagnell

*Attorney, Agent, or Firm*—Marger, Johnson, McCollom & Stolowitz

[57] ABSTRACT

A cutting tool assembly consisting of a cutting bit and a mounting block assembly for fixing the bit on a rotating drum or the like which will retain the bit in the mounting block at very high drum rotational speeds, which will accommodate high impact force and minimize the resulting wear experienced by the bit at high drum rotational speeds, and which permits quick and simple replacement of the bit when required.

17 Claims, 1 Drawing Sheet

CUTTING TOOL BIT ASSEMBLY

BACKGROUND OF THE INVENTION

1. Field of the Invention

The present invention relates generally to trenching assemblies, and in particular to trenching tool assemblies for the high speed trenching of highway surfaces.

2. Description of Related Art

Machines used for trenching concrete, asphalt, rock and the like generally include a plurality of bits rigidly mounted on a rotating mechanism which impacts the bits against the surface. The driven mechanism carrying the bits may be a rotating drum, disk, or a continuous flexible chain for example. Owing to the nature of the materials being trenched, extremely high impact forces are required to be transmitted by the bits. Even greater impact forces are experienced by the bits as the trenching machines are designed to be operated at higher speeds to increase the cutting rate of the machines. As a result, the bits wear quickly and must be frequently replaced. If the machine is to be operated efficiently, the rate of bit wear must be minimized, and bit replacement must be simple and quick.

Bits and bit mounting assemblies have been developed to rigidly mount the bit and mounting block to a rotating drum to withstand the extremely high impact forces, while allowing for ready replacement, such as that disclosed in U.S. Pat. No. 4,337,980 to Krekeler, for example. Another design, incorporated in the Fansteel 765 Series bits available from VR/Wesson Lexington, utilizes an expandable collar fitted around the shank of a bit, and which expands into a recess formed in the mounting block to secure the bit in place. As drum rotation speeds and impact forces increase, however, these known methods of mounting bits on the drum become less satisfactory due to their inability to counter the high centrifugal forces urging the bits out of the mounting blocks at high drum rotation speeds, while at the same time minimizing the damage to the bit from the accompanying high impact forces.

A need remains therefore for a trenching bit and mounting block assembly which allows the bit to enjoy a suitably long life, retains the bit within the mounting block at very high drum rotational speeds, and which allows quick and easy replacement of bits when required.

SUMMARY OF THE INVENTION

It is an object of the present invention to provide a trenching bit and a mounting block assembly for fixing the bit on a rotating drum or the like which will retain the bit in the mounting block at very high drum rotational speeds, which will accommodate high impact force and minimize the resulting wear experienced by the bit at high drum rotational speeds, and which permits quick and simple replacement of the bit when required.

Accordingly, the present invention is embodied in a trenching tool assembly comprising an elongate bit having a cutting head, and having a cylindrical shank protruding axially from the cutting head, the shank including a tapered shoulder adjacent the cutting head and a distal end. The assembly includes a bit mounting block having a front surface, a rear surface and an aperture extending therebetween for slidably receiving the shank in the mounting block, the aperture having a tapered portion adjacent the mounting block front surface for engaging the tapered shoulder of the shank. A bit retaining means is provided which is fixable to the shank distal end for retaining the shank in the mounting block. When so mounted, the bit shank is rotatable and slidable in the mounting block between a first axial position where the bit retaining means is engaged against the mounting block rear surface, and a second axial position where the tapered shoulder portion of the bit is engaged with the tapered portion of the mounting block aperture. The distance between the first and second axial bit positions is approximately one eighth of an inch in an embodiment for providing relatively low pavement material removal rates, and approximately one quarter of an inch in an embodiment for providing relatively high pavement material removal rates. The bit retaining means may comprise an axial threaded hole formed in the shank distal end, and a bolt engaged with the threaded axial hole, or may alternatively comprise the shank distal end having a threaded portion and a threaded nut engaged therewith. The cutting head may include a tapered cutting tip, which may have a carbide or other suitably hard and tough material applied to its surface.

The invention may also be embodied in an apparatus comprising a rotatable drum having an outer surface on which bit and mounting block assemblies as just described are mounted. The drum may be rotatable at speeds of greater than 600 RPM's.

These and other features of the present invention are best understood by reference to the following figures and description of the preferred embodiment.

DETAILED DESCRIPTION OF THE PREFERRED EMBODIMENT

Figure 1:
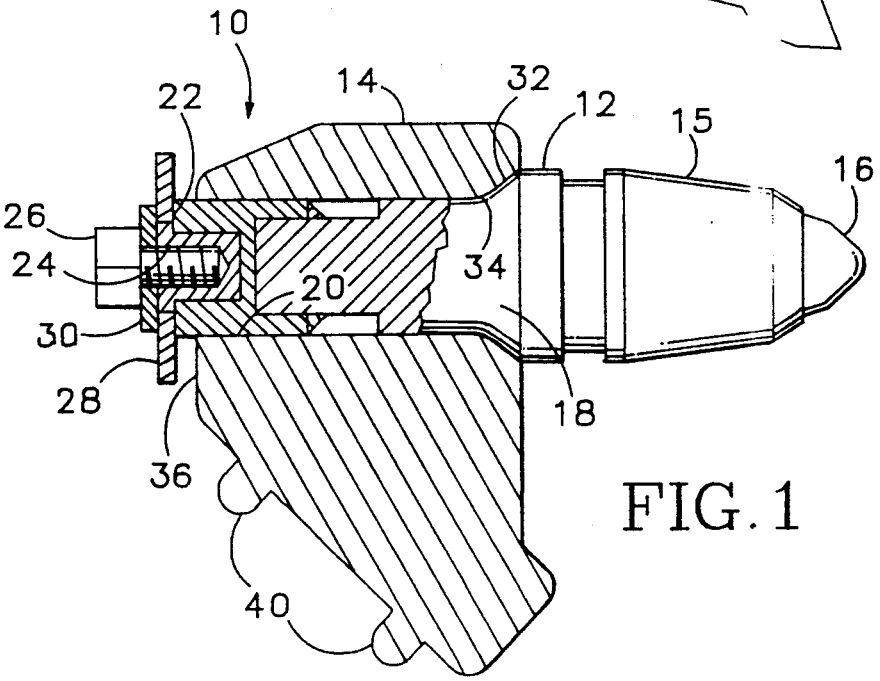
FIG. 1 is a cross sectional side view of a cutting tool bit assembly according to the present invention.

Referring to FIG. 1, a cutting tool assembly according to the preferred embodiment is shown generally at 10. Assembly 10 consists of bit 12 and mounting block 14. Bit 12 is preferably made from a tool steel, and includes a head 15 having conical cutting tip 16, which is preferably surfaced with a carbide material such as titanium carbide. Head 15 is mounted on a shank 18 of tool steel which extends through a hole 20 in steel mounting block 14. Shank 18 terminates at end 22, into which is bored a threaded hole 24. A hardened flat washer 28 and a lock washer 30 are placed on bolt 26, which is then threaded into hole 24 to retain bit 12 in place in mounting block 14. Shank 18 includes a shoulder 32 adjacent head 15, and aperture 20 in mounting block 14 includes a complementary tapered surface 34. Bit 12 is rotatable as well as slidable axially within hole 20 between a first axial position with shoulder 32 against tapered surface 34 (as shown), and a second axial position with flat washer 28 against surface 36 of mounting block 14.

Figure 2:
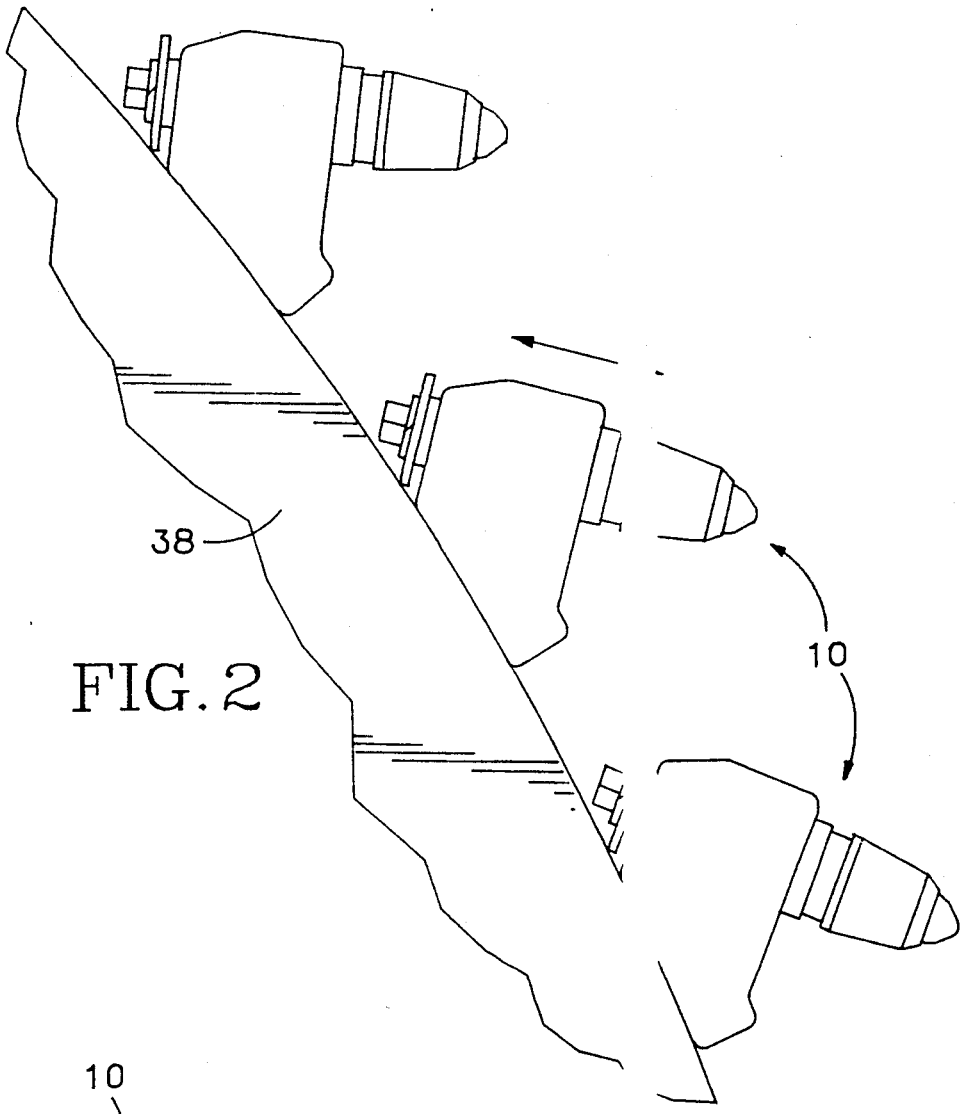
FIG. 2 is a partial side view of a rotatable drum having showing a plurality of cutting tool bit assemblies mounted thereon.

Referring additionally now to FIG. 2, each assembly 10 is located in a fixed position on a drum 38 by means of two locating pins 40 protruding from the bottom of mounting block 14, and is permanently fixed thereto by being welded to the drum surface. Drum 38 is a solid mild steel cylinder having a diameter of 18 inches and a length of 24 inches. A plurality of assemblies 10 are fixed on the drum surface in an offset alternating pattern for cutting a trench in a highway surface approximately 5 inches wide, for example, although the particular arrangement may be chosen possible to best suit the requirements of the particular application. In the preferred embodiment, hole 20 in mounting block 14 is oriented so as to position bit 12 at an angle of about 45 degrees relative to a tangent line of the drum surface. This particular angle has been found to provide a good combination of cutting rate, debris removal from the trench, and bit life. Drum 38 is mounted on a frame assembly (not shown) which may either be towed or driven at a relatively slow speed along the desired path or pattern for the required trenching. Applicant has discovered that this combined rotational and axial motion of bit 12 within hole 24 results in reduced wear of bit tip 16, and makes possible significantly higher rotational speeds since the resulting higher impact forces which would lead to bit failure in known bit assemblies can now be accommodated, and since the bits can now be effectively retained within the mounting block at the higher rotational speeds.

In operation, drum 38 is rotated, typically by a hydraulic motor (not shown), preferably at a rotational speed of between 600 and 1000 RPM's. The centrifugal force of the drum's rotation urges each bit 12 axially forward in mounting block 14 until flat washer 28 contacts mounting block 14. The drum is then lowered toward until cutting assemblies 10 engage the pavement surface to be cut. As the bit tip 16 engages the pavement, shank 18 is forced radially upwardly against the wall of hole 20, and axially rearwardly until shoulder 32 contacts tapered surface 34 of hole 20. The friction encountered by shank 18 due to the upward pressure slows its axial travel, softening the impact of shoulder 32 against tapered surface 34, and providing a somewhat gradual build-up of pressure against on bit tip 16. It has been found that a predetermined amount of axial displacement, along with a frictional slowing of the bit during its axial travel upon engagement with the pavement surface permits extended operation at heretofore unachievable rotational speeds. Moreover, the number of bits thrown from their mounting blocks is reduced compared with known bit and mounting block designs.

Having the invention in terms of the preferred embodiment, it will be apparent to those skilled in the art that details and materials may be modified or substituted without departing from the spirit and scope of the following claims, all of which are intended to be claimed.

I claim:

1. A trenching tool assembly comprising:

an elongate bit having a cutting head;

a shank protruding axially from the cutting head, the shank including a tapered shoulder adjacent the cutting head, and further including a distal end;

a bit mounting block having a front surface, a rear surface and an aperture extending therebetween for slidably receiving the shank in the mounting block, the aperture having a tapered portion adjacent the mounting block front surface for engaging the tapered shoulder of the shank;

bit retaining means fixable to the shank distal end for retaining the shank in the mounting block, the bit retaining means comprising an axial threaded hole formed in the shank distal end, and a bolt engaged with the threaded axial hole; and the bit shank being slidable in the mounting block between a first axial position whereat the bit retaining means is engaged against the mounting block rear surface, and a second axial position whereat the tapered shoulder portion of the bit is engaged with the tapered portion of the mounting block aperture.

2. A trenching tool assembly according to claim 1 wherein the cutting head includes a tapered cutting tip.

3. A trenching tool assembly according to claim 1 wherein the cutting head includes a cutting tip having a carbide material on its surface.

4. A trenching tool assembly according to claim 1 wherein the distance between the first and second axial bit positions is approximately one eighth of an inch.

5. A trenching tool assembly according to claim 1 wherein the distance between the first and second axial bit positions is approximately one quarter of an inch.

6. A trenching tool assembly comprising;

an elongate bit having a cutting head;

a shank protruding axially from the cutting head, the shank including a tapered shoulder adjacent the cutting head, and further including a distal end;

a bit mounting block having a front surface, a rear surface and an aperture extending therebetween for slidably receiving the shank in the mounting block, the aperture having a tapered portion adjacent the mounting block front surface for engaging the tapered shoulder of the shank;

bit retaining means fixable to the shank distal end for retaining the shank in the mounting block, the bit retaining means comprising the shank distal end having a threaded portion, and a threaded nut engaged therewith; and the bit shank being slidable in the mounting block between a first axial position whereat the bit retaining means is engaged against the mounting block rear surface, and a second axial position whereat the tapered shoulder portion of the bit is engaged with the tapered portion of the mounting block aperture.

7. A trenching tool assembly according to claim 6 wherein the cutting head includes a tapered cutting tip.

8. A trenching tool assembly according to claim 6 wherein the cutting head includes a cutting tip having a carbide material on its surface.

9. A trenching tool assembly according to claim 6 wherein the distance between the first and second axial bit positions is approximately one eighth of an inch.

10. A trenching tool assembly according to claim 6 wherein the distance between the first and second axial bit positions is approximately one quarter of an inch.

11. A trenching tool assembly comprising:

a rotatable drum;

an elongate bit having a cutting head;

a shank protruding axially from the cutting head, the shank including a tapered shoulder adjacent the cutting head, and further including a distal end;

a bit mounting block mounted on an outer surface of the rotatable drum and having a front surface, a rear surface and an aperture extending therebetween for slidably receiving the shank in the mounting block, the aperture having a tapered portion adjacent the mounting block front surface for engaging the tapered shoulder of the shank;

the bit shank portion slidably received within the bit mounting block aperture;

bit retaining means fixable to the shank distal end for retaining the shank in the mounting block, the bit retaining means comprising an axial threaded hole formed in the shank distal end, and a bolt engaged with the threaded axial hole; and the bit shank being slidable in the mounting block between first axial position whereat the bit retaining means is engaged against the mounting block rear surface, and a second axial position whereat the tapered shoulder portion of the bit is engaged with the tapered portion of the mounting block aperture.

12. A trenching tool assembly according to claim 11 wherein the rotatable drum outer surface includes bit mounting holes, and the mounting block includes a mounting pin received within the bit mounting holes.

13. A trenching tool assembly according to claim 11 wherein the rotatable drum is generally cylindrical and has a diameter of approximately 18 inches, and has a rotational velocity of at least 600 revolutions per minute.

14. A trenching tool assembly according to claim 11 further comprising a plurality of mounting blocks and bits mounted on said rotatable drum outer surface.

15. A trenching tool assembly according to claim 11 further comprising means for rotatably driving the drum.

16. A trenching tool assembly according to claim 15 wherein the means for rotatably driving the drum comprises a hydraulic motor.

17. A trenching tool assembly comprising:

a rotatable drum;

an elongate bit having a cutting head;

a shank protruding axially from the cutting head, the shank including a tapered shoulder adjacent the cutting head, and further including a distal end;

a bit mounting block mounted on an outer surface of the rotatable drum and having a front surface, a rear surface and an aperture extending therebetween for slidably receiving the shank in the mounting block, the aperture having a tapered portion adjacent the mounting block front surface for engaging the tapered shoulder of the shank;

the bit shank portion slidably received within the bit mounting block aperture;

bit retaining means fixable to the shank distal end for retaining the shank in the mounting block, the bit retaining means comprising the shank distal end having a threaded portion, and a threaded nut engaged therewith; and the bit shank being slidable in the mounting block between first axial position whereat the bit retaining means is engaged against the mounting block rear surface, and a second axial position whereat the tapered shoulder portion of the bit is engaged with the tapered portion of the mounting block aperture.

* * * * *